US007056113B2

(12) United States Patent
Bachinski et al.

(10) Patent No.: US 7,056,113 B2
(45) Date of Patent: Jun. 6, 2006

(54) GAS LIGHT SYSTEMS AND METHODS OF OPERATION

(75) Inventors: Thomas J. Bachinski, Lakeville, MN (US); Robb Edward Bennett, Prior Lake, MN (US); Douglas Mark Holm, Minneapolis, MN (US)

(73) Assignee: Fire Stone Home Products, LLC, Bloomington, MN (US)

( * ) Notice: Subject to any disclaimer, the term of this patent is extended or adjusted under 35 U.S.C. 154(b) by 0 days.

(21) Appl. No.: 10/803,535

(22) Filed: Mar. 17, 2004

(65) Prior Publication Data

US 2005/0208448 A1 Sep. 22, 2005

(51) Int. Cl.
*F23D 14/28* (2006.01)

(52) U.S. Cl. ..... 431/344

(58) Field of Classification Search ..... 431/103, 431/36, 37, 206, 344; 285/181, 272
See application file for complete search history.

(56) References Cited

U.S. PATENT DOCUMENTS

| | | | | | |
|---|---|---|---|---|---|
| 35,984 | A * | 7/1862 | Bassett | 431/344 |
| 107,743 | A * | 9/1870 | Whitney | 431/344 |
| 282,115 | A * | 7/1883 | Pintsch | 431/344 |
| 423,367 | A * | 3/1890 | Young | 431/344 |
| 1,042,750 | A * | 10/1912 | Bader | 431/344 |
| 3,590,806 | A * | 7/1971 | Locke | 431/344 |
| 3,721,516 | A * | 3/1973 | Reese | 431/202 |
| 3,723,045 | A * | 3/1973 | Reese | 431/18 |
| 3,941,554 | A | 3/1976 | Curtis | |
| 4,702,690 | A | 10/1987 | Sommers et al. | |
| 4,830,606 | A | 5/1989 | Dillinger | |
| 4,867,191 | A | 9/1989 | Walters | |
| 5,468,142 | A | 11/1995 | Koziol | |
| 5,478,232 | A * | 12/1995 | Dillinger et al. | 431/255 |
| 5,636,978 | A | 6/1997 | Sasaki | |
| 5,902,100 | A | 5/1999 | Long | |
| 6,113,384 | A | 9/2000 | Sebastiani | |
| 6,446,623 | B1 | 9/2002 | Resmo et al. | |
| 6,470,877 | B1 * | 10/2002 | Waters | 126/92 AC |
| 6,485,290 | B1 | 11/2002 | Long | |
| 2002/0055075 | A1 | 5/2002 | Long | |
| 2003/0017430 | A1 | 1/2003 | Long | |
| 2003/0136396 | A1 | 7/2003 | Resmo et al. | |
| 2003/0178944 | A1 | 9/2003 | Willamor et al. | |
| 2003/0223226 | A1 | 12/2003 | Long | |

* cited by examiner

*Primary Examiner*—S. Gravini
(74) *Attorney, Agent, or Firm*—Merchant & Gould P.C.

(57) ABSTRACT

A gas light assembly including a stand member having a recessed portion sized to receive a fuel container. The recessed portion is accessible through an opening of the stand member. A panel member is coupled to the stand member and movable between a closed position covering the recessed portion and an open position wherein the recessed portion is accessible for inserting or removing the fuel container.

21 Claims, 3 Drawing Sheets

GAS LIGHT SYSTEMS AND METHODS OF OPERATION

BACKGROUND OF THE INVENTION

1. Field of the Invention

The present invention generally relates to lighting systems, and more specifically relates to gas light systems and methods of operating the same.

2. Related Art

Outdoor lighting systems typically require a source of energy such as electricity or some type of combustible fuel such as natural gas or propane in order to produce light. Such energy sources are often routed from a home or other living structure as electrical lines or fuel lines that are buried or otherwise concealed in the path between the living structure and the light-generating device. Installing and maintaining such routed lines can be costly and difficult depending on a number of variables including, for example, the distance and terrain separating the living structure and the light-generating device. These lighting systems, in particular gas lighting systems, are also not typically portable between a number of locations. An improved light system that addresses these and other disadvantages of known outdoor lighting systems would be an advance in the art.

SUMMARY OF THE INVENTION

The present invention relates to gas light systems and methods of operating gas lighting systems. An example gas light system according to principles of the invention includes a light-generating member, a stand member including a recessed portion sized to receive a fuel container, and a panel member coupled to the stand member and configured to cover an opening in the recessed portion when in a closed position to conceal the fuel container. The stand member supports the light-generating member at a base thereof. A fuel line is configured to deliver fuel from the fuel container to the light-generating member when the fuel container is positioned in the recessed portion.

The above summary of the present invention is not intended to describe each disclosed embodiment or every implementation of the present invention. Figures in the detailed description that follow more particularly exemplify embodiments of the invention. While certain embodiments will be illustrated and describing embodiments of the invention, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

Figure 2:
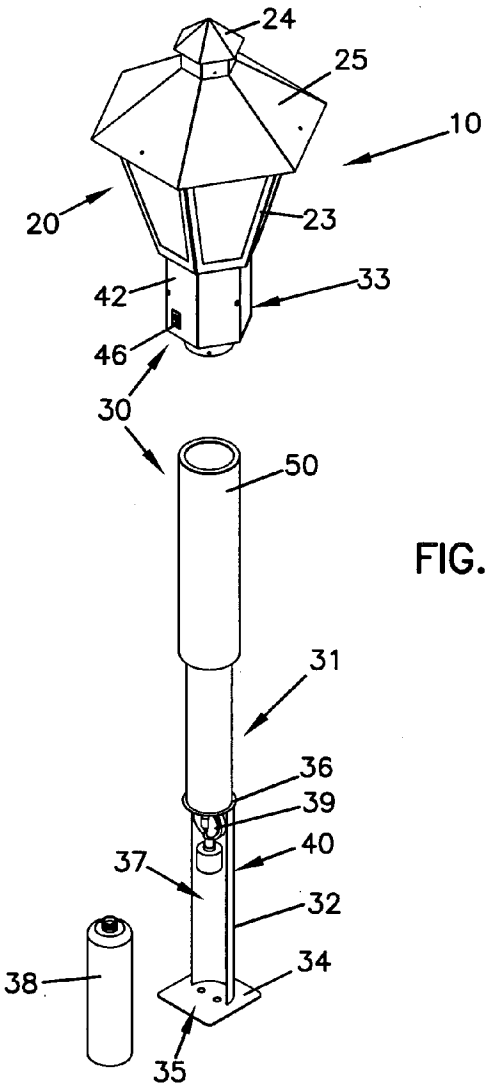
FIG. 2 is an exploded top perspective view of the assembly shown in FIG. 1.
Figure 1:
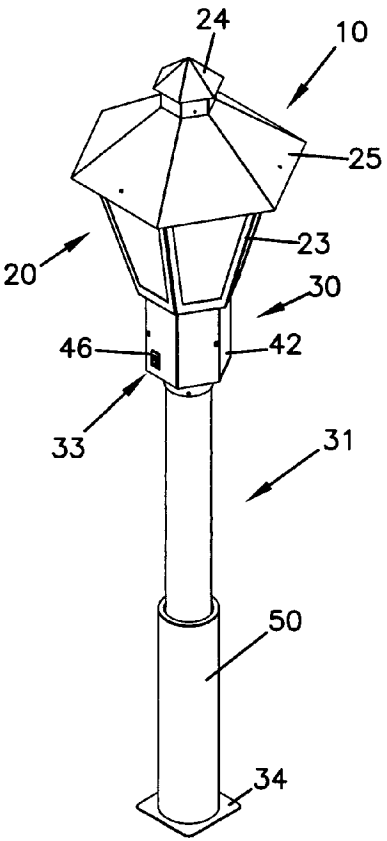
FIG. 1 is a top perspective view of an example gas light assembly according to principles of the invention.

While the invention is amenable to various modifications and alternate forms, specifics thereof have been shown by way of example and the drawings, and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION OF THE PREFERRED EMBODIMENT

The present invention generally relates to gas lighting systems and methods of operating gas lighting systems. More specifically, the present invention relates to a gas light that includes a stand member including a recessed portion sized to receive a fuel container. A panel member is coupled to the stand member and configured to cover at least a portion of the recessed portion when in a closed position to conceal at least a portion of the fuel container.

Referring to FIGS. 1–5, a gas light system 10 is shown. The gas light system 10 is a portable system that can be positioned as desired.

The gas light system 10 includes a light-generating member 20. The light-generating member 20 defines an interior space 22 (see FIG. 5) in which combustible gas can be ignited to generate a flame that is visible from and generates light to the outside of the light-generating member 20 through one or more transparent panels (not clearly shown) positioned within a frame 23. Alternatively, the transparent panels can be removed from the light-generating member. A top cap 24 is coupled to a roof member 25 of the light-generating member 20 and is configured to allow exhaust to exit the interior space 22. The light-generating member 20 is a mere example light-generating device and may be any device or structure capable of providing a source of light.

The gas light system 10 also includes a stand member 30. The stand member 30 includes a lower portion 31 defining a recessed portion 32 and an upper portion 33. The lower portion 31 of stand member 30 can be cylindrical in shape. Alternatively, the stand member 30 and lower portion 31 can be a different shape.

The lower portion 31 of the stand member 30 includes a base 34. The base 34 defines holes 35 through which one or more fastening members (not shown) can be used to attach the gas light system 10 to another structure such as a deck floor, a deck rail, a wall, or other structure. The base 34 can be any desired shape. In alternative embodiments, the base can be coupled to another structure through any suitable fastening device that secures the gas light system 10 to the structure. For example, a mounting bracket can be attached to a structure and the base of the stand member can be sized to fit within the mounting bracket. In some embodiments, multiple mounting brackets at multiple locations may be used for mounting the portable gas light system at a selected location.

The recessed portion 32 defines an opening 37 (see FIG. 2) that is sized to receive a fuel container 38. A coupling member 40 is positioned within the stand member 30 to connect to the fuel container 38. The coupling member 40 is attached to a fuel line 41 through a regulator 39. The fuel line 41 extends vertically from the recessed portion 32 toward the light-generating member 20 through a hollow interior space of the stand member 30. The stand member also includes a locking ring 36 positioned above the opening 37.

The upper portion 33 of the stand member 30 includes a gas valve housing 42 coupled to the light-generating member 20 at an end 43. A gas valve 44 is positioned within the gas valve housing 42 to receive fuel from the fuel line 41.

Figure 4:
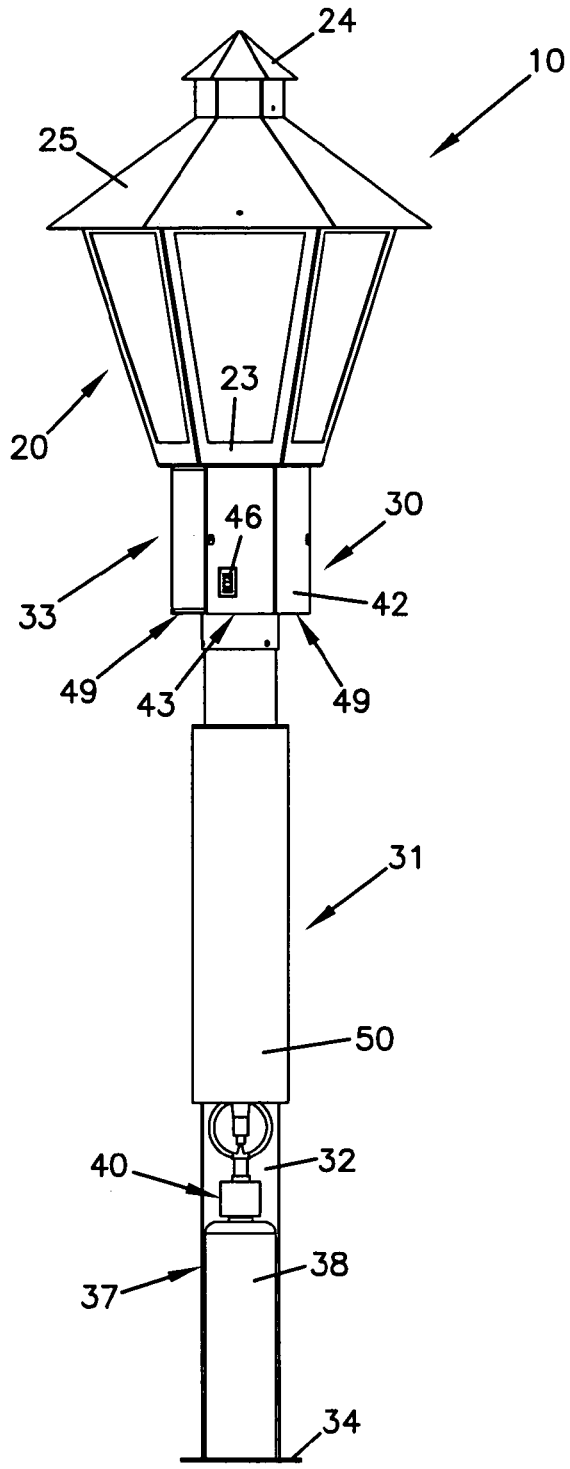
FIG. 4 is a front view of the assembly shown in FIG. 1 with the panel in an open position.

A supply line 45 extends from the gas valve 44 into the interior space 22. Combustible gas exits the supply line 45 for combustion within the interior space 22. A switch 46 is coupled to the gas valve housing 42 to allow for the activation of an igniter 47 such as, for example, a piezoelectric ignition system, that extends from the switch 46 into the interior space 22 to start combustion of the gas exiting the supply line 45. The switch 46 can also be used to start the flow of gas through the gas valve 42. For example, as the switch 46 is engaged, a voltage from a battery can be sent to the gas valve 42 causing the gas valve 42 to open. Alternatively, the gas valve 42 can include a manual adjustment system that regulates the flow of combustible gas to the supply line 45. Air is provided through the end 43 of the gas valve housing 42 as shown in FIG. 4 by arrows 49. The air feeds the combustion of the gas and generation of the flame within the interior space 22.

Alternatively, the gas valve housing and gas valve can be positioned within a different portion of the stand member and can be of a different shape such as a cylindrical shape that is sized to match the diameter of the remainder of and forming an integral part of the stand member. For example, the gas valve can be positioned closer to the coupling and a longer supply line can be used to provide combustible gas to the light-generating member. The switch 46 can also be positioned in a different location on the gas light system.

A panel member 50 is coupled to the stand member 30 and configured to move or slide generally in direction X (see FIG. 3) along the stand member 30. The panel member 50 can extend around the entire circumference of the lower portion 31 of the stand member 30. Alternatively, the panel member can extend around a portion of the lower portion sufficient to cover the opening in the recessed portion, or can be hinged, hung, fastened, or otherwise secured in any suitable way to stand member 30. For example, a door can be hinged to the stand member 30 to cover the opening 37 when in a closed position.

Figure 5:
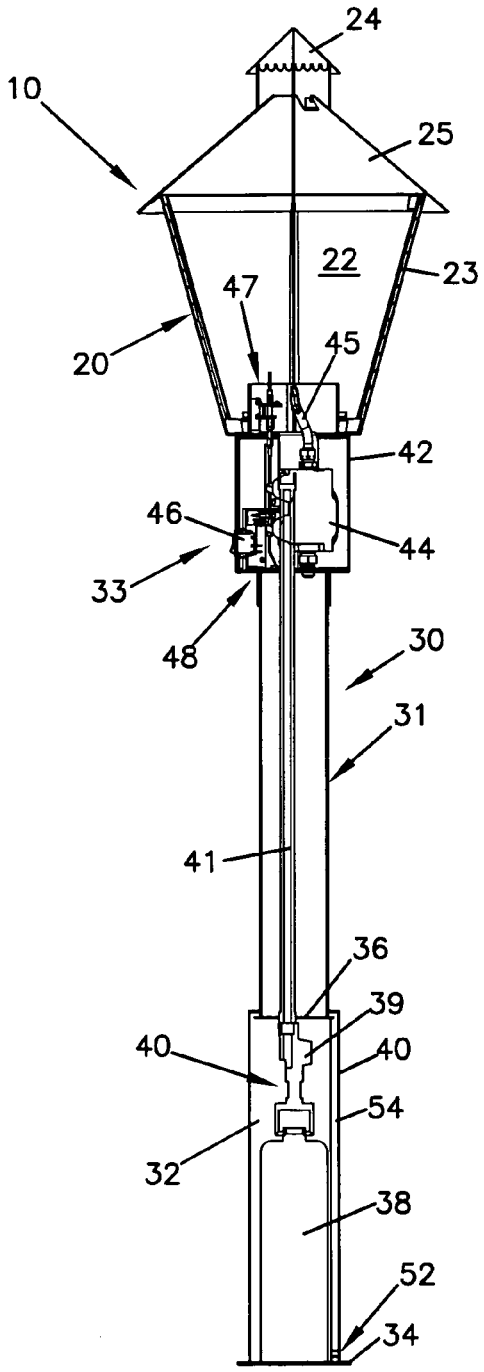
FIG. 5 is a cross-sectional view of the assembly shown in FIG. 3 taken along cross-sectional indicators 5—5.

As shown in FIG. 5, a locking tab 52 can be coupled to the panel member 50. The locking tab 52 can be constructed of a semi-rigid yet flexible material. Alternatively, the locking tab can be formed of a solid material. The locking tab 52 is sized to fit within a space 54 defined between the stand member 30 and panel member 50.

When the fuel container 38 becomes empty, the panel member 50 can be vertically raised to expose the fuel container 38 and the coupling member 40. The fuel container 38 can then be disconnected from the coupling member 40 and removed from the recessed portion 32 through the opening 37. The empty fuel container then can be replaced with a full fuel container. After replacing the empty fuel container, the panel member can then be lowered back to the closed position.

Figure 3:
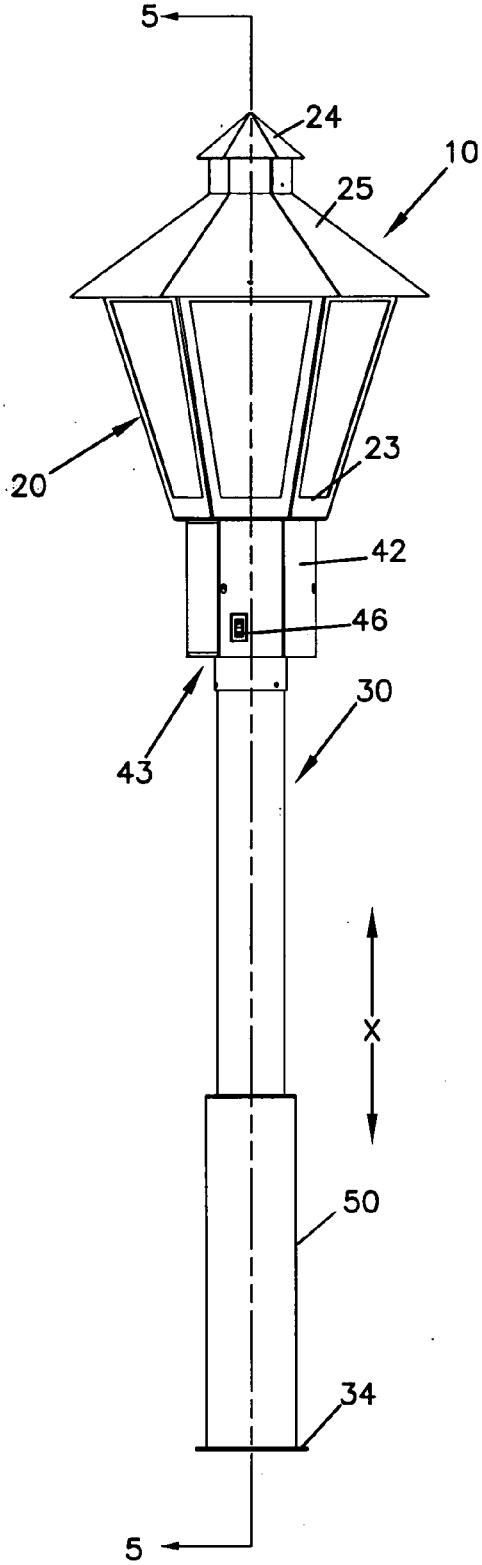
FIG. 3 is a front view of the assembly shown in FIG. 1 with the panel member in a closed position.

As the panel member 50 is moved from the closed position shown in FIG. 3 to the open position shown in FIG. 4, the locking tab 52 can engage the locking ring 36 to hold the panel member 50 in the open position while the fuel container 38 is disconnected from the coupling member 40 and replaced with another fuel container.

In an alternative embodiment, the locking ring can define a lock opening sized to allow a solid locking tab to pass through the lock opening. After the locking tab passes through the lock opening, the panel member can be rotated to allow the locking tab to engage the locking ring and hold the panel member in the open position. Many other devices and structures can be used to hold the panel member 50 in an open position. Similar devices and structures may also be used to hold the panel member 50 in a closed position or at some intermediate position between the open and closed position.

The present invention should not be considered limited to the particular examples or materials described above, but rather should be understood to cover all aspect of the invention as fairly set out in the attached claims. Various modifications, equivalent processes, as well as numerous structures to which the present invention may be applicable will be readily apparent to those of skill in the art to which the present invention is directed upon review of the instant specification.

We claim:

1. A gas light assembly, comprising:

a stand member having a recessed portion sized to receive a fuel container, the recessed portion being accessible through an opening in a sidewall of the stand member;

a panel member coupled to the stand member and vertically slidable between a closed position covering the opening and an open position wherein the opening is accessible for inserting the fuel container into the recessed portion or removing the fuel container from the recessed portion.

2. The assembly of claim 1, further comprising a light-generating member coupled to an end of the stand member and a fuel line extending between the recessed portion and the light-generating member.

3. The assembly of claim 1, further comprising a coupling member positioned in the recessed portion and configured to couple the fuel container to the assembly.

4. The assembly of claim 1, wherein the stand member includes a hollow cylindrical lower portion that defines the recessed portion, and the recessed portion is sized to receive a cylindrical shaped fuel container.

5. The assembly of claim 1, wherein the assembly includes a base configured to support the assembly in an upright position.

6. The assembly of claim 1, wherein the assembly is portable.

7. The assembly of claim 1, wherein the panel member extends around an entire outer circumference of the stand member.

8. The assembly of claim 1, further comprising a locking mechanism configured to lock the panel member in the open position.

9. The assembly of claim 1, wherein the stand member further comprises a gas valve housing.

10. The assembly of claim 9, wherein a gas valve member is housed within the gas valve housing.

11. The assembly of claim 1, wherein the stand member further comprises an upper portion including a gas valve housing and a lower portion including the recessed portion.

12. A gas light assembly, comprising:

a stand member having a recessed portion sized to receive a fuel container, the recessed portion being accessible through an opening in a sidewall of the stand member;

a panel member coupled to the stand member and vertically movable between a closed position covering the opening and an open position wherein the opening is accessible for inserting the fuel container into the recessed portion or removing the fuel container from the recessed portion; and a locking mechanism configured to lock the panel member in the open position.

13. The assembly of claim 12, further comprising a light-generating member coupled to an end of the stand member and a fuel line extending between the recessed portion and the light-generating member.

14. The assembly of claim 12, further comprising a coupling member positioned in the recessed portion and configured to couple the fuel container to the assembly.

15. The assembly of claim 12, wherein the panel member is slidable between the open and closed positions.

16. The assembly of claim 12, wherein the stand member includes a hollow cylindrical lower portion that defines the recessed portion, and the recessed portion is sized to receive a cylindrical shaped fuel container.

17. The assembly of claim 12, wherein the assembly is portable.

18. The assembly of claim 12, wherein the panel member extends around an entire outer circumference of the stand member.

19. The assembly of claim 12, wherein the stand member further comprises a gas valve housing.

20. The assembly of claim 12, wherein a gas valve member is housed within the gas valve housing.

21. The assembly of claim 12, wherein the stand member further comprises an upper portion including a gas valve housing and a lower portion including the recessed portion.

* * * * *

UNITED STATES PATENT AND TRADEMARK OFFICE

CERTIFICATE OF CORRECTION

PATENT NO. : 7,056,113 B2
APPLICATION NO. : 10/803535
DATED : June 6, 2006
INVENTOR(S) : Bachinski et al.

It is certified that error appears in the above-identified patent and that said Letters Patent is hereby corrected as shown below:

Col. 6, claim 20 should read -- The assembly of claim 19, --

Signed and Sealed this

Seventh Day of November, 2006

JON W. DUDAS
*Director of the United States Patent and Trademark Office*